US008022681B2

(12) United States Patent
Gurcan

(10) Patent No.: US 8,022,681 B2
(45) Date of Patent: Sep. 20, 2011

(54) HYBRID LOW DROPOUT VOLTAGE REGULATOR CIRCUIT

(75) Inventor: Hakan Ates Gurcan, Los Gatos, CA (US)

(73) Assignee: Decicon, Inc., San Jose, CA (US)

( * ) Notice: Subject to any disclaimer, the term of this patent is extended or adjusted under 35 U.S.C. 154(b) by 0 days.

(21) Appl. No.: 12/729,142

(22) Filed: Mar. 22, 2010

(65) Prior Publication Data

US 2010/0237839 A1 Sep. 23, 2010

Related U.S. Application Data

(63) Continuation of application No. 11/956,070, filed on Dec. 13, 2007, now abandoned.

(60) Provisional application No. 60/870,574, filed on Dec. 18, 2006.

(51) Int. Cl.
*G05F 1/00* (2006.01)

(52) U.S. Cl. ..... 323/283

(58) Field of Classification Search ..... 323/241, 323/171, 280–283

See application file for complete search history.

(56) References Cited

U.S. PATENT DOCUMENTS 2,220,099 A 11/1940 Fritz Guenther et al.
3,020,099 A 2/1962 Smith
4,473,744 A 9/1984 Mizokami
6,046,577 A 4/2000 Rincon-Mora et al.
6,160,325 A 12/2000 Turvey
6,201,375 B1 3/2001 Larson et al.
6,246,221 B1 * 6/2001 Xi ..... 323/280
6,246,222 B1 6/2001 Nilles et al.
6,388,433 B2 5/2002 Marty
6,437,638 B1 8/2002 Coles et al.
6,465,994 B1 10/2002 Xi
6,674,274 B2 1/2004 Hobrecht et al.
6,677,735 B2 1/2004 Xi
6,696,882 B1 2/2004 Markowski et al.
6,839,252 B2 1/2005 Tai et al.
6,856,124 B2 2/2005 Dearn
6,933,772 B1 8/2005 Banerjee et al.
6,977,489 B2 12/2005 Isham (Continued)

OTHER PUBLICATIONS

Austria Micro Systems—Liberty: Power Management IP Library from Mobile Applications—Analog LDO—Low Power, Low Noise, Low Dropout, 150mA Voltage Regulator, Feb. 2002, pp. 1-4.

(Continued)

*Primary Examiner* — Adolf Berhane
*Assistant Examiner* — Yemane Mehari
(74) *Attorney, Agent, or Firm* — Kilpatrick Townsend & Stockton LLP; Ardeshir Tabibi

(57) ABSTRACT

A voltage regulator circuit includes a digital control block, an amplifier and a transistor. The digital control block receives a first reference voltage and a feedback voltage, converts the received voltages from analog to digital signals, performs an integration operation on the converted signals, and converts the result of the integration operation to an analog signal. The amplifier is responsive to the output of the digital control block and to a regulated output voltage of the regulator circuit. The transistor has a first terminal responsive to the output of the amplifier, a second terminal that receives the input voltage being regulated, and a third terminal that supplies the regulated output voltage. The transistor may be an NMOS or a bipolar NPN transistor. The feedback voltage may be generated by dividing the regulated output voltage. The digital control block optionally generates a biasing signal to bias the amplifier.

2 Claims, 8 Drawing Sheets

U.S. PATENT DOCUMENTS

| | | | | |
|---|---|---|---|---|
| 6,989,659 | B2 | 1/2006 | Menegoli et al. | |
| 7,009,348 | B2 | 3/2006 | Mogilner et al. | |
| 7,102,394 | B1 | 9/2006 | Wilson et al. | |
| 7,109,691 | B2 | 9/2006 | Brooks et al. | |
| 7,167,054 | B1 | 1/2007 | Dening et al. | |
| 7,262,658 | B2 | 8/2007 | Ramaswamy et al. | |
| 7,304,464 | B2 | 12/2007 | Weng et al. | |
| 7,327,127 | B2 | 2/2008 | Ho | |
| 7,333,348 | B2 | 2/2008 | Horiuchi et al. | |
| 7,342,392 | B2 | 3/2008 | Liao | |
| 7,348,840 | B2 | 3/2008 | Magrath et al. | |
| 7,397,226 | B1 | 7/2008 | Mannama et al. | |
| 7,402,985 | B2 | 7/2008 | Zlatkovic | |
| 7,414,471 | B2 | 8/2008 | Krishnan et al. | |
| 7,486,058 | B2 * | 2/2009 | Szepesi | 323/272 |
| 7,501,801 | B2 | 3/2009 | Brown et al. | |
| 7,531,996 | B2 | 5/2009 | Yang et al. | |
| 2007/0114985 | A1 | 5/2007 | Latham et al. | |
| 2008/0150368 | A1 | 6/2008 | Gurcan | |
| 2008/0150500 | A1 | 6/2008 | Gurcan | |
| 2008/0157740 | A1 | 7/2008 | Gurcan | |
| 2008/0174289 | A1 | 7/2008 | Gurcan et al. | |
| 2009/0015066 | A1 | 1/2009 | Guo et al. | |

OTHER PUBLICATIONS

Linear Technology—LTC3025 300mA Micropower VLDO Linear Regulator, Data Sheet, Copyright 2004, pp. 1-12, Linear Technology Corp.

Requirement for Restriction/Election for U.S. Appl. No. 11/957,357, mailed on Oct. 30, 2009, 9 pages.

Non-Final Office Action for U.S. Appl. No. 11/957,357, mailed on Mar. 25, 2010, 7 pages.

Non-Final Office Action for U.S. Appl. No. 11/957,305, mailed on Nov. 13, 2009, 10 pages.

Non-Final Office Action for U.S. Appl. No. 11/956,070, mailed on Sep. 22, 2009, 9 pages.

Non-Final Office for U.S. Appl. No. 11/939,377, mailed on Nov. 16, 2009, 8 pages.

Final Office Action for U.S. Appl. No. 11/957,357, mailed on Oct. 27, 2010, 11 pages.

Final Office Action for U.S. Appl. No. 11/957,305, mailed on Aug. 23, 2010, 17 pages.

Non-Final Office Action for U.S. Appl. No. 11/939,377, mailed on Jul. 23, 2010, 18 pages.

Notice of Allowance for U.S. Appl. No. 11/957,305, mailed on Feb. 11, 2011.

* cited by examiner

HYBRID LOW DROPOUT VOLTAGE REGULATOR CIRCUIT

CROSS-REFERENCES TO RELATED APPLICATIONS

The present application is a continuation of U.S. application Ser. No. 11/956,070, filed Dec. 13, 2007, which claims benefit under 35 USC 119(e) of U.S. Provisional Application No. 60/870,574, filed on Dec. 18, 2006, entitled "Hybrid Low Dropout Voltage Regulator Circuit," the content of which is incorporated herein by reference in its entirety.

The present application is related to U.S. application Ser. No. 11/939,377, filed Nov. 13, 2007, entitled "Fast Low Dropout Voltage Regulator Circuit", the content of which is incorporated herein by reference in its entirety.

BACKGROUND OF THE INVENTION

Low dropout regulators are widely used for powering electronic circuit blocks. In applications where the power conversion efficiency is not particularly demanding, they are preferred over switching regulators for to their simplicity and ease of use.

FIG. 1 is a transistor schematic diagram of an LDO regulator 10, as known in the prior art. LDO regulator 10 includes a pair of amplifiers 12 and 14, and a pass transistor 16. Amplifier 14 together with pass transistor 16 form a fast and high current unity gain voltage follower adapted to maintain output voltage VOUT within a predefined range in response to a fast load transient. Amplifier 12 is used to form an outer feedback loop adapted to control the DC accuracy of regulator 10. In order to guarantee stable operation while satisfying output voltage accuracy requirements, system partitioning is made such that amplifier 14 has relatively low voltage gain and high bandwidth whereas amplifier 12 has a relatively high voltage gain and low bandwidth. Amplifier 12 additionally has a requirement for low input referred offset voltage as it directly impacts the accuracy of the output voltage of regulator 10. The low bandwidth, high gain and low input offset requirements are generally satisfied with specialized manufacturing processes which supports integrated capacitors and components with good matching properties, which are also expensive compared to non-specialized manufacturing processes. Additionally, the resulting amplifier 10 is usually one of the largest circuit blocks in size, compared to other blocks in the LDO.

BRIEF SUMMARY OF THE INVENTION

In accordance with one embodiment of the present invention, a voltage regulator circuit includes, in part, a digital control block, an amplifier and a transistor. The digital control block receives a first reference voltage and a feedback voltage, converts the received voltages from analog to digital signals, performs an integration operation, and converts the result of the integration operation to an analog signal. The amplifier is responsive to the output of the digital control block and to a regulated output voltage of the regulator circuit. The transistor has a first terminal responsive to the output of the amplifier, a second terminal that receives the input voltage being regulated, and a third terminal that supplies the regulated output voltage.

In one embodiment, the transistor is an N-type or P-type MOS transistor. In another embodiment, the transistor is a bipolar NPN or PNP transistor. In one embodiment, the feedback voltage is generated by dividing the regulated output voltage. In another embodiment, the feedback voltage represents the regulated output voltage. In one embodiment, the digital control block further includes a memory, and a clock and timing signal generation block. In one embodiment, the digital control block generates a biasing signal used to bias the amplifier. In one embodiment, the voltage regulator circuit further includes a controlled discharge circuit responsive to an output of the digital control block and adapted to provide a discharge path from the third terminal of the transistor to ground.

In accordance with one embodiment of the present invention, a voltage regulator circuit includes, in part, a digital control block and N voltage regulation channels. The digital control block receives a first reference voltage, and further selectively receives one of N feedback voltages each associated with a different one of N voltage regulation channels. Each voltage regulation channel further includes a sample-and-hold block responsive to an output of the digital control block, an amplifier responsive to an output of the associated sample-and-hold block, and a transistor having a first terminal responsive to an output of its associated amplifier, a second terminal receiving one of N input voltages being regulated, and a third terminal supplying one of the N associated regulated output voltages.

A method of regulating a voltage, in accordance with one embodiment of the present invention includes, in part, performing a digital integration operation in response to a reference voltage and a feedback voltage thereby to generate an integrated signal, performing an amplification operation in response to the integrated signal and a regulated output voltage signal thereby to generate an amplified signal, and applying the amplified signal to a first terminal of a transistor. A second terminal of the transistor receives an input voltage signal being regulated, and a third terminal of the transistor supplies the regulated output voltage.

In one embodiment, the feedback voltage is generated by dividing the regulated output voltage. In another embodiment, the feedback voltage is the regulated output voltage. In one embodiment, the transistor is an N-type or P-type MOS transistor. In another embodiment, the transistor is a bipolar NPN or PNP transistor. In one embodiment, the method further includes providing a discharge path from the third terminal of the transistor to ground.

DETAILED DESCRIPTION OF THE INVENTION

Figure 1:
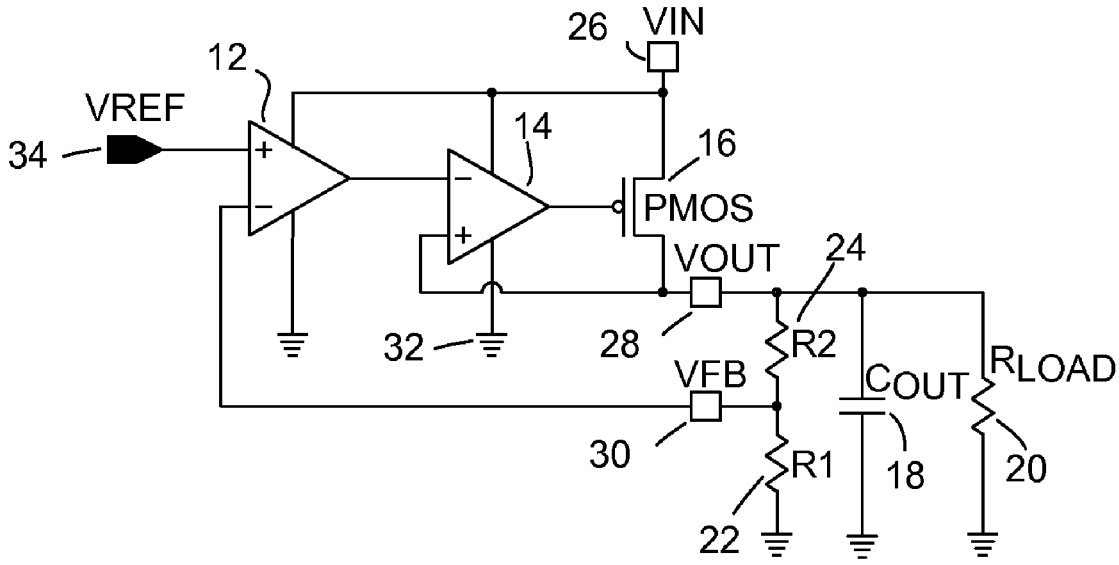
FIG. 1 (Prior Art)
FIG. 1 is a block diagram of a low drop-out (LDO) voltage regulator, as known in the prior art.
Figure 2:
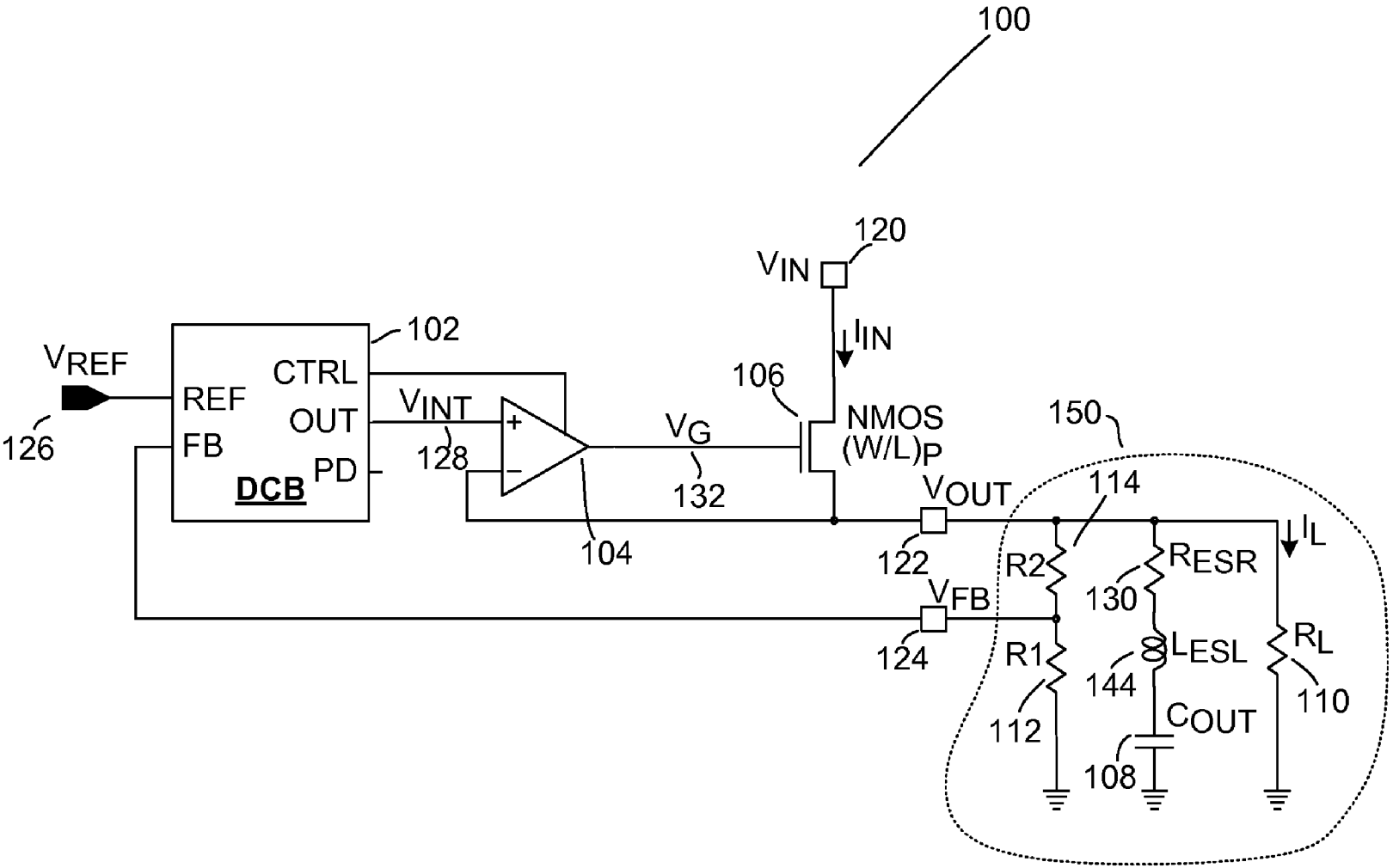
FIG. 2 is a schematic diagram of a hybrid LDO (HLDO) voltage regulator, in accordance with one embodiment of the present invention.

FIG. 2 is a block diagram of a hybrid low drop-out (HLDO) linear integrated circuit 100, in accordance with one embodiment of the present invention. HLDO 100 is shown as including, in part, a digital control block (DCB) 102, an amplifier 104, and a pass element 106. DCB 102 and amplifier 104 form a dual-feedback loop control circuit adapted to regulate output voltage VOUT delivered to output node 122. The following description is provided with reference to pass element 106 being an NMOS transistor 106. It is understood that any other type transistor, PMOS, bipolar NPN or PNP, transistor, or otherwise, may also be used. For example, by reversing the input polarities of amplifier 104, a PNP or a PMOS transistor may be used in place of NMOS transistor 106.

DCB 102 is used to form a digital feedback loop (DFL) adapted to control the DC accuracy of regulator 100. Amplifier 104 is a low-gain, high-bandwidth amplifier (LGHBA) that together with NMOS transistor 106 form a fast and high current unity gain voltage follower. Amplifier 104 forms an analog feedback loop (AFL) adapted to maintain output voltage VOUT within a predefined range in response to a fast load transient. Input voltage VIN regulated by HLDO regulator 100 is received via an input terminal 120. Reference voltage VREF applied to DCB 102 is received by input terminal 126 but may be internally generated using any one of a number of conventional design techniques.

Components collectively identified using reference numeral 150 are externally supplied to ensure proper operation of HLDO regulator 100. Resistors 114 and 112 divide the output voltage VOUT—delivered to output terminal 122—to generate a feedback voltage VFB that is supplied to DCB 102 via input terminal 124. Accordingly, voltage VOUT is defined by the following expression:

$$VOUT=VREF*(R1+R2)/R1 \quad (1)$$

where R1 and R2 are the resistances of resistors 112 and 114, respectively.

Resistor 110, having the resistance $R_L$, represents the load seen by HLDO regulator 100. Output capacitor 108, having the capacitance $C_{OUT}$, is used to maintain loop stability and to keep output voltage VOUT relatively constant during load transients. Capacitance $C_{OUT}$ is typically selected to have a relatively large value to keep output voltage VOUT within a predefined range while the dual-feedback loops respond and regain control in response to a load transient. Resistor 130 represents the inherent equivalent series resistance (ESR) of output capacitor 108. The resistance $R_{ESR}$ of resistor 130 is defined by the construction and material of capacitor 108. Inductor 144 represents the inherent equivalent series inductance (ESL) of output capacitor 108. The inductance of inductor 144 is defined by the construction and material of the capacitor 108. In voltage regulator applications where fast transient response is important, capacitor 108 is typically a ceramic chip capacitor which is characterized by low ESR and ESL values compared to its tantalum and aluminum electrolytic counterparts. For a typical 1 μF 10V ceramic chip capacitor 108, representative values for the ESR and ESL are $R_{ESR}$=10 mΩ, $L_{ESL}$=1 nH.

Figure 3:
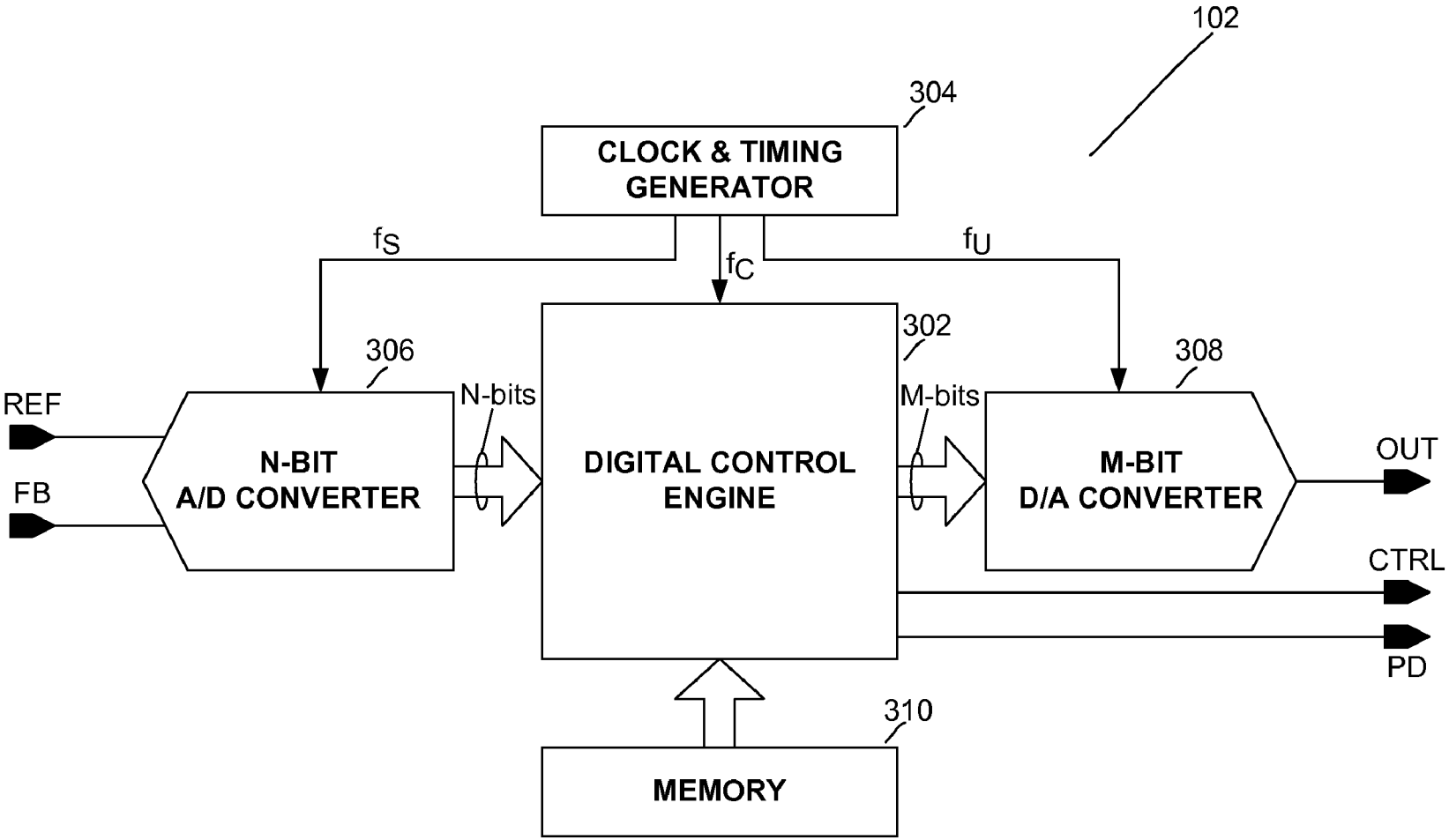
FIG. 3 is a block diagram of the digital control block of FIG. 2, in accordance with one embodiment of the present invention.

FIG. 3 is a block diagram of DCB 102, in accordance with one embodiment of the present invention. Referring concurrently to FIGS. 2 and 3, N-Bit Analog-to-Digital Converter (ADC) 306 is shown as having differential inputs and a sampling rate of $f_S$. In another embodiments, described below, ADC 306 may have a single-ended input. ADC 306 samples the voltage difference between reference voltage VREF and feedback voltage VFB and converts this difference to a corresponding N-bit wide digital code word at its output.

The Digital Control Engine (DCE) 302 receive the N-bit wide digital code word from ADC 306 and processes it according to a control algorithm to provide an M-bit wide digital code word that is supplied to Digital-to-Analog Converter (DAC) 308. The algorithm implemented by DCE 302 may be a digital filter algorithm mimicking the behavior of a high-gain low-bandwidth amplifier, such as an integrator, or may be a non-linear function adapted to bring the output voltage $V_{OUT}$ close to reference voltage $V_{REF}$ such that the difference between voltages $V_{OUT}$ and $V_{REF}$ is less than a predefined value. DAC 308 uses the M-bit word to bring the output voltage VOUT back into regulation using the slower time constants of the DFL. The resolution of ADC 306, i.e., N, is typically selected so as to be less than the DAC 308 resolution, i.e., M, to avoid limit cycling of the output voltage. DAC 308 generates an analog voltage signal at its output in response to the M-bit wide digital code word it receives at its input. The voltage generated by DAC 308 is applied to an input terminal of amplifier 104. Signal CTRL generated by DCE 302 is optionally used to control the operations of one or more blocks of an HLDO of the present invention. For example, signal CTRL may be used to set the bias currents/voltages to optimize the performance of the various analog blocks disposed in an HLDO of the present invention to account for environment parameters, external component values and operating conditions. In the embodiment shown in FIG. 2, signal CTRL is shown as being used to optimize the operating condition of amplifier 104.

Memory 310 supplies information to DCE 302. Although not shown, in one embodiment, memory 310 includes a non-volatile (NVM) and a volatile Memory (VM). The NVM may be used to store such data as, e.g., calibration information, loop parameters, external component values and parameters for the programmable features of the regulator that are desired to be retained in case of a power loss. VM may be used as a scratch pad by the DCE 302 and may also store run-time status information. The Clock & Timing Generator 304 generates the timing signals for the ADC 306, DCE 302, DAC 308, and memory 310.

In one embodiment, ADC 306 has a single-ended input and may sample the signals REF and FB signals at different times, store them in MEM 30, and compute the difference in digital domain. In another embodiment, the difference between the values of signals REF and FB may be determined by an analog signal conditioning circuit. The output of the signal conditioning circuit is then applied to the single-ended ADC 306.

Figure 4A:
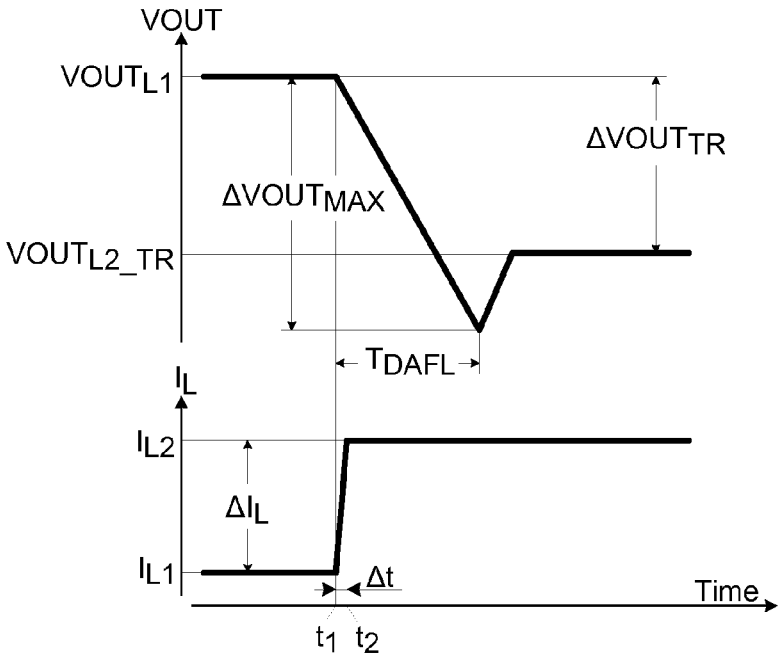
FIG. 4A illustrates the short-term transient response of the output voltage of the HLDO regulator of FIG. 2.

Referring to FIGS. 3 and 4A concurrently, assume the load current IL changes from a low level IL1 to a higher level IL2 in a time interval Δt that is small compared to the response time $T_{DAFL}$ of the AFL and that the current through resistor 114 is negligible compared to IL1 or IL2. Also assume that the voltage VINT applied to the input terminal of amplifier 104 remains relatively constant within time intervals close to $T_{DAFL}$. These are valid assumptions since the response time $T_{DDFL}$ of the Digital Feedback Loop is larger than $T_{DAFL}$. The output load transient event is illustrated in FIG. 4A.

When a large load current transient is applied to the output, it causes on the output voltage (i) a voltage spike induced by the ESL, (ii) an offset voltage induced by the ESR and (iii) a voltage droop caused by the loop response time. The effects of $L_{ESL}$ and $R_{ESR}$ can be kept relatively small by proper selection of external components and by following proper layout techniques. As an example, a load current step of 0 to 100 mA in 100 ns would cause a peak output voltage deviation of 1 mV due to 1 nH of ESL. The contribution of ESR to the transient output voltage deviation is also relatively small. As an example, a load current step of 0 to 100 mA would cause a peak output voltage deviation of 1 mV due to 10 mΩ of ESR. The voltage droop is caused by the non-zero loop response time $T_{DAFL}$. Assuming that $\Delta I_L$ is the difference between $I_{L2}$ and $I_{L1}$, the following approximation can be written about the droop rate:

$$d(VOUT)/dt=\Delta I_L/C_{OUT} \quad (2)$$

During the period $T_{DAFL}$, the load current is supplied by $C_{OUT}$. At the end of $T_{DAFL}$, the maximum output voltage deviation from the initial regulation value of $VOUT_{L1}$ may be written as:

$$\Delta VOUT_{max}=\Delta I_L*T_{DAFL}/C_{OUT} \quad (3)$$

After the expiration of $T_{DAFL}$, the AFL brings the output voltage to $VOUT_{L2_TR}$, as shown by the following expression.

$$\Delta VOUT_{TR}=VOUT_{L1}-VOUT_{L2_TR}\approx\Delta V_{GS}/A_{LGHBA} \quad (4)$$

In expression (4), $A_{LGHBA}$ represents the voltage gain of the amplifier 104, $\Delta V_{GS}$ is the voltage difference between the gate-to-source voltages $V_{GS2}$ and $V_{GS1}$ of NMOS 106 at drain current levels of $I_{L2}$ and $I_{L1}$ respectively, and $\Delta VOUT_{TR}$ represents the transient load regulation characteristic of the LDO regulator 100.

The following are exemplary numerical values of a few parameters associated with LDO regulator 100 of FIG. 2. This example shows that the AFL catches the output voltage at a voltage level 30 mV lower than the no-load output voltage in response to a fast-load transient:

$I_{L1}=0$ $I_{L2}=100$ mA $A_{LGHBA}=20$ $T_{DAFL}=300$ ns $C_{OUT}=1$ μF $V_{GS_L1}=500$ mV (at $I_{L1}=0$)

$V_{GS_L2}=900$ Mv (at $I_{L2}=100$ mA)

Figure 4B:
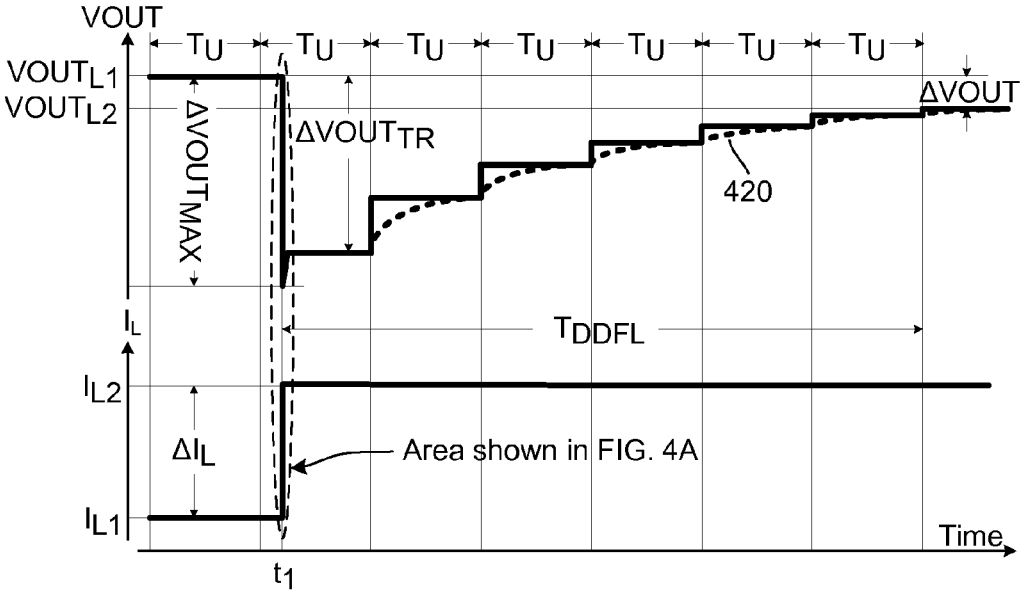
FIG. 4B illustrates the long-term transient response of the output voltage of the HLDO regulator of FIG. 2.

$d(VOUT)/dt=\Delta I_L/C_{OUT}=100$ mV/μs $\Delta VOUT_{MAX}=\Delta I_L*T_{DAFL}/C_{OUT}=30$ mV $\Delta VOUT_{TR}=\Delta V_{GS}/A_{LGHBA}=20$ mV After the initial events described above, DCB 102 which has a response time of $T_{DDFL}$ brings the output voltage back to DC regulation as shown in FIG. 4B. This is partly accomplished by DAC 308 which updates the voltage at node 128 (see FIG. 2) at a rate of $f_U$ updates per second. Parameter $TU_U$ is equal to $1/f_U$ in FIG. 4B. The output will be brought back to within ΔVOUT of $VOUT_{L1}$ after a time period of $T_{DDFL}$ by the slower outer feedback loop built around DCB 102. Voltage difference ΔVOUT which characterizes the DC load regulation characteristic of the HLDO regulator 100 is defined below:

$$\Delta VOUT=\Delta V_{GS}/(A_{LGHBA}*ADCB)*(R1+R2)/R1 \quad (5)$$

where $A_{LGHBA}$ represents the DC voltage gain of amplifier 104, and ADCB represents the equivalent DC gain of the DCB 102 from the inputs of ADC 306 to the outputs of DAC 308.

The following are exemplary numerical values of a few parameters associated with HLDO regulator 100 of FIG. 3:

$R1=R2=100$ kΩ

$A_{LGHBA}=20$ $ADCB=400$ $V_{GS_L1}=500$ mV (at $I_{L1}=0$)

$V_{GS_L2}=900$ mV (at $I_{L2}=100$ mA)

$\Delta VOUT=0.1$ mV

If smoother transitions are desired at the output between DAC updates, a smoothing circuit (not shown) can be placed between the DAC output and amplifier 104. For example, an RC low pass filter may be used to provide the smoothing function. The resulting output voltage waveform when such a smoothing circuit is used is shown in FIG. 4B as dotted lines 420.

Figure 5:
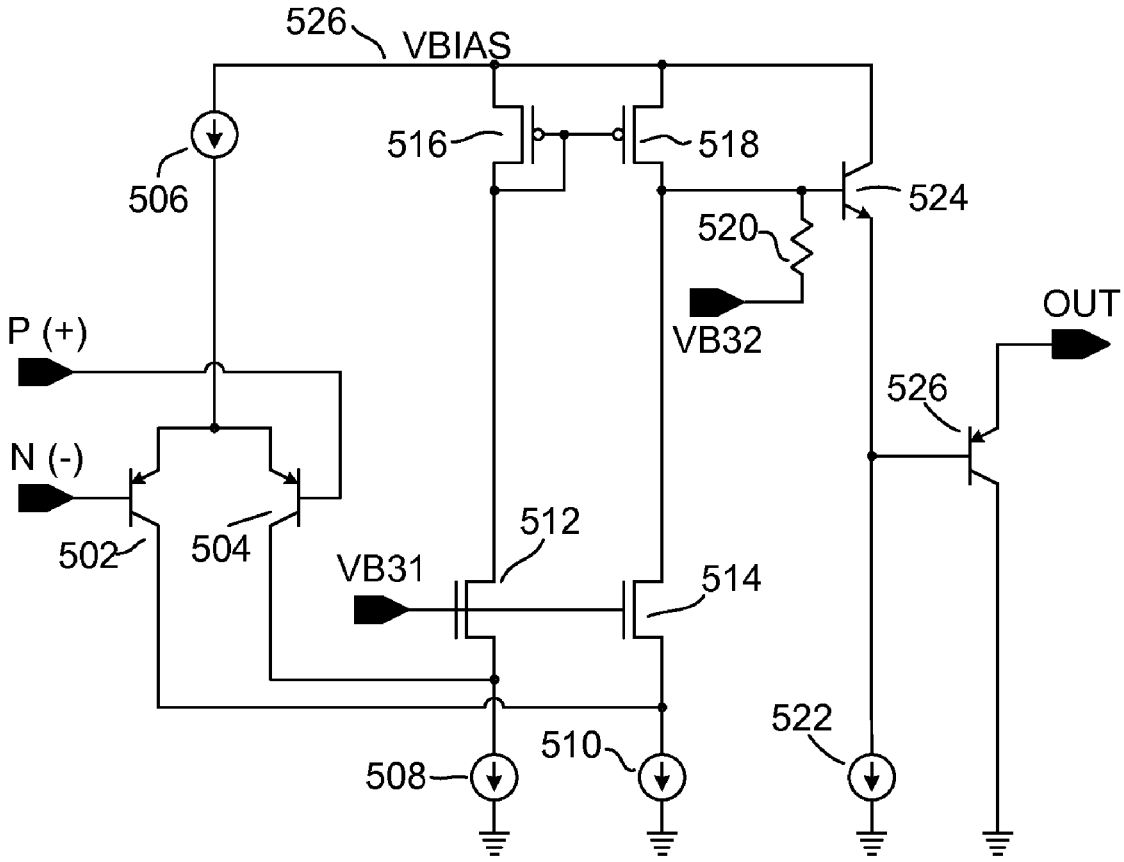
FIG. 5 is a schematic diagram of an exemplary low-gain high-bandwidth amplifier disposed in the HLDO voltage regulator of FIG. 2, in accordance with one embodiment of the present invention.

FIG. 5 is a transistor schematic diagram of amplifier 104 of FIG. 2, according to one embodiment of the invention. As seen from FIG. 5, amplifier 104 is shown as including a folded cascode amplification stage buffered by a voltage follower output stage. Bias voltages VB31 and VB32 may be generated using any one of a number of conventional design techniques. In one embodiment, bias voltage VB32 is connected to the output node of the LDO regulator (not shown). PNP transistors 502 and 504 form the input differential pair. Current source 506 sets the tail current of the input differential pair and defines the transconductance of the input stage, as shown below:

$$g_{m302,304}=I_{306}/(2*V_T) \quad (6)$$

In expression (6), parameter $V_T$ represents the thermal voltage. Cascode transistors 512 and 514 together with current sources 508 and 510, transfer the transconductance of the input stage of the cascode to the output stage of the cascode where the current mirror formed by transistors 516 and 518 converts the differential signals to a single-ended signal. The output impedance of the cascode at the drain terminals of transistors 514 and 518 is large compared to the resistance of resistor 520. Similarly, the input impedance of the NPN transistor 524 is large compared to the resistance of resistor 520. Resistor 520 is thus used to set the output impedance at the output of the cascode. The voltage gain of the amplifier 102 is defined by the following expression:

$$A_{LGHBA}=g_{m302,304}*R_{320} \quad (7)$$

For example, when $g_{m302,304}=200$ μA/V, and $R_{320}=100$ kΩ, $A_{LGHBA}$ is 20. NPN transistor 524, biased by current source $I_{322}$, is used as an emitter follower to buffer the output of the cascode. PNP transistor 526 level shifts the output signal to a voltage level more suitable for driving the gate terminal of output pass-transistor, and provides further buffering. PNP 526 is biased by current source 136 which supplies a substantially constant bias current $I_{CB}$. The output resistance of closed-loop amplifier 102 is defined by the small signal output impedance of transistor 326 and may be written as shown below:

$$r_O = V_T I_{CB} \quad (8)$$

Figure 6:
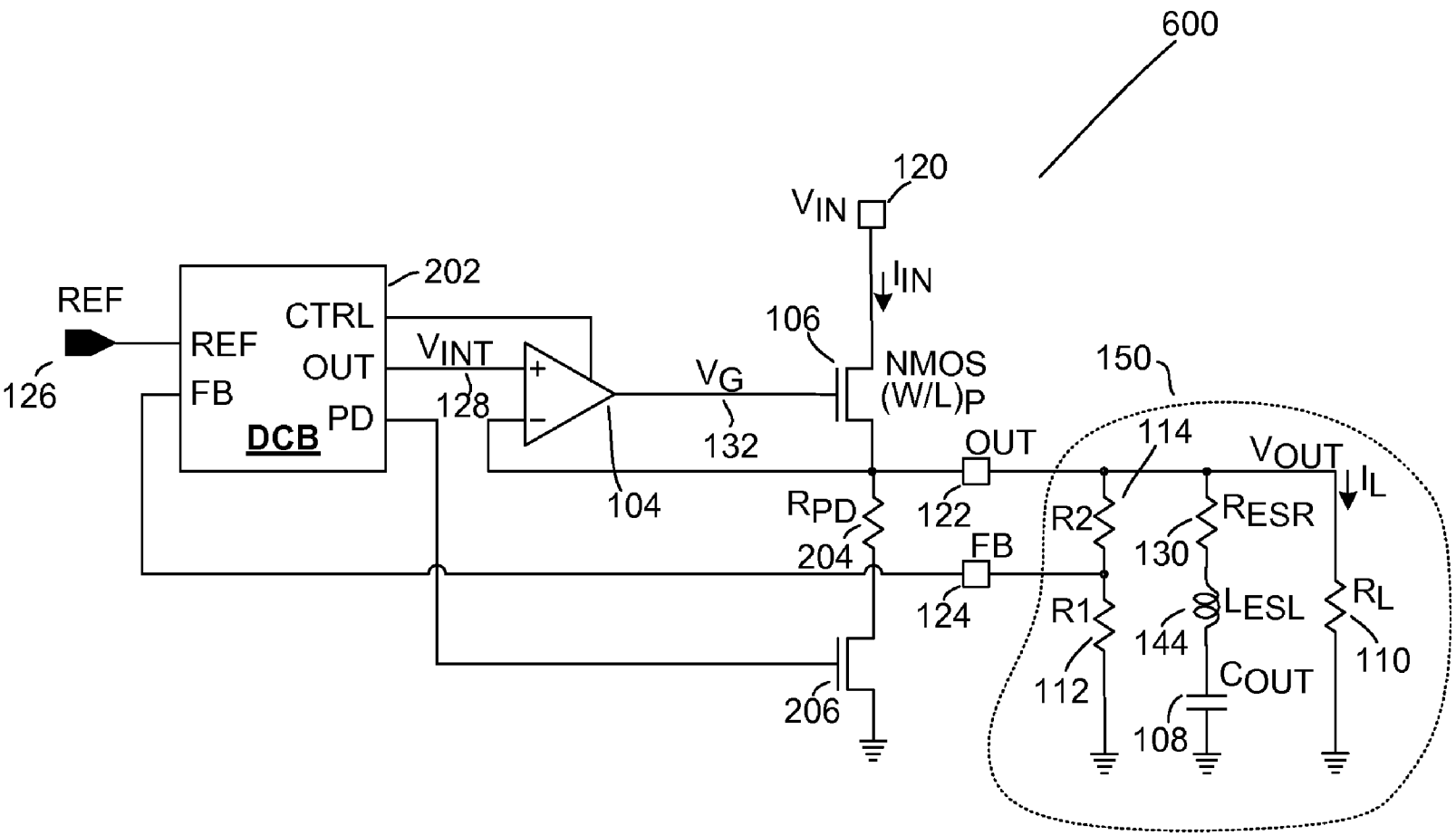
FIG. 6 is a schematic diagram of an HLDO voltage regulator, in accordance with another embodiment of the present invention.

FIG. 6 is a block diagram of an HLDO 600, in accordance with another embodiment of the present invention. HLDO 600 is similar to HLDO 100 except that includes an NMOS transistor 206 and a pull-down resistor 204. NMOS transistor 206 and pull-down resistor 204 are used to bring the output voltage $V_{OUT}$ back into regulation when the load $R_L$ is suddenly removed from the output. To achieve this, DCE 302 is adapted to determine whether voltage $V_{INT}$—generated in response to a new DAC code—is lower, by a predefined value, than the voltage $V_{INT}$ that is generated in response to a previous DAC code. If so determined, DCE 302 considers the load as having been removed. To avoid output voltage overshoot, DCE 302 causes NMOS 206 to turn on via signal PD. This, in turn, loads the output with resistor 204 to inhibit the overshoot. Thereafter, DCE 302 compares the present value of DAC 308's output value with its previous value to determine whether the overshoot condition is corrected. If the result of the comparison is greater than a predefined value, DCE 302 disables transistor 206.

Figure 7:
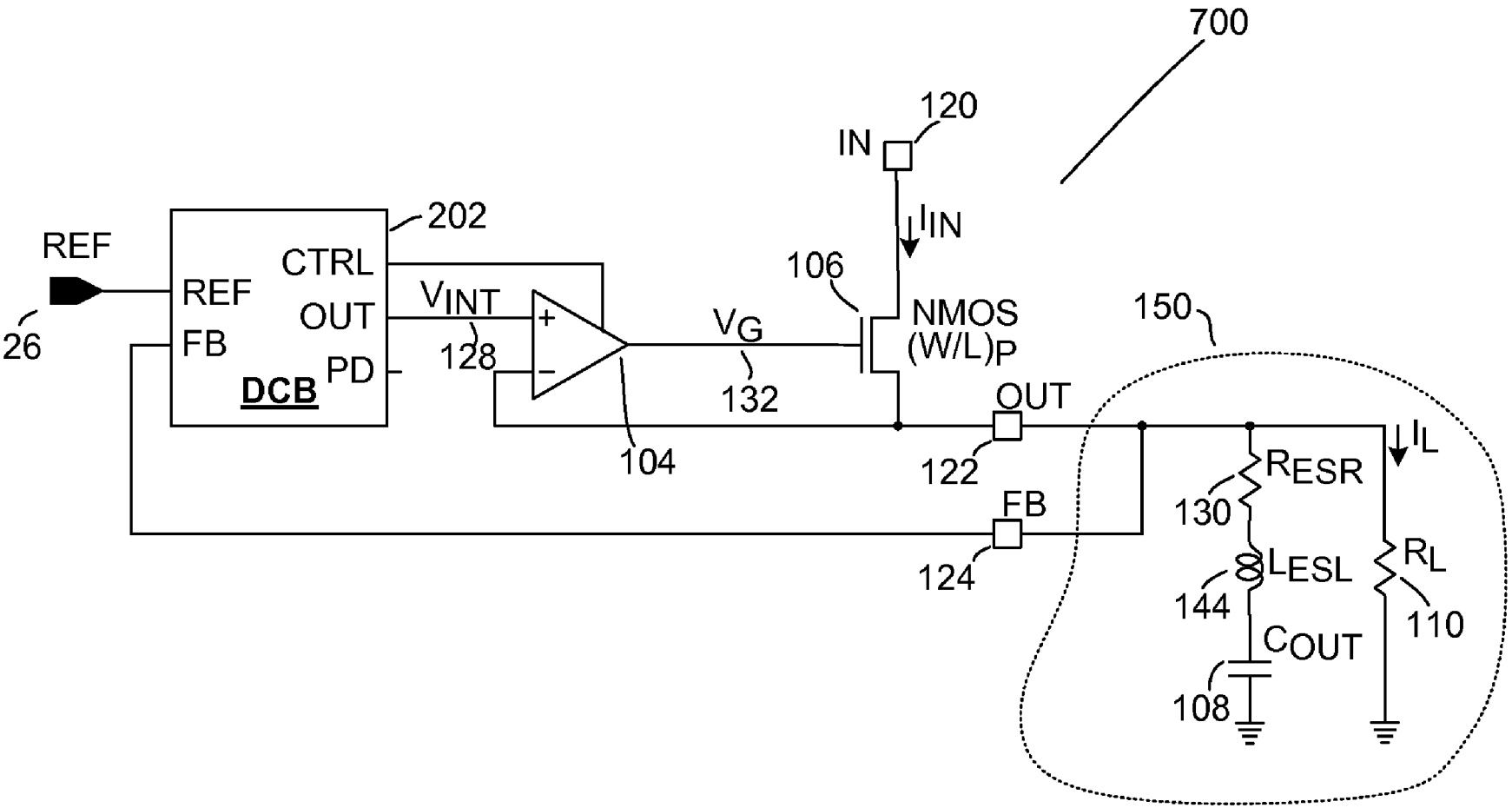
FIG. 7 is a schematic diagram of an HLDO voltage regulator, in accordance with another embodiment of the present invention.

FIG. 7 is a block diagram of an HLDO 700, in accordance with another embodiment of the present invention. In HLDO 700, DCB 302 samples the output voltage $V_{OUT}$ directly and without using a voltage divider.

Figure 8:
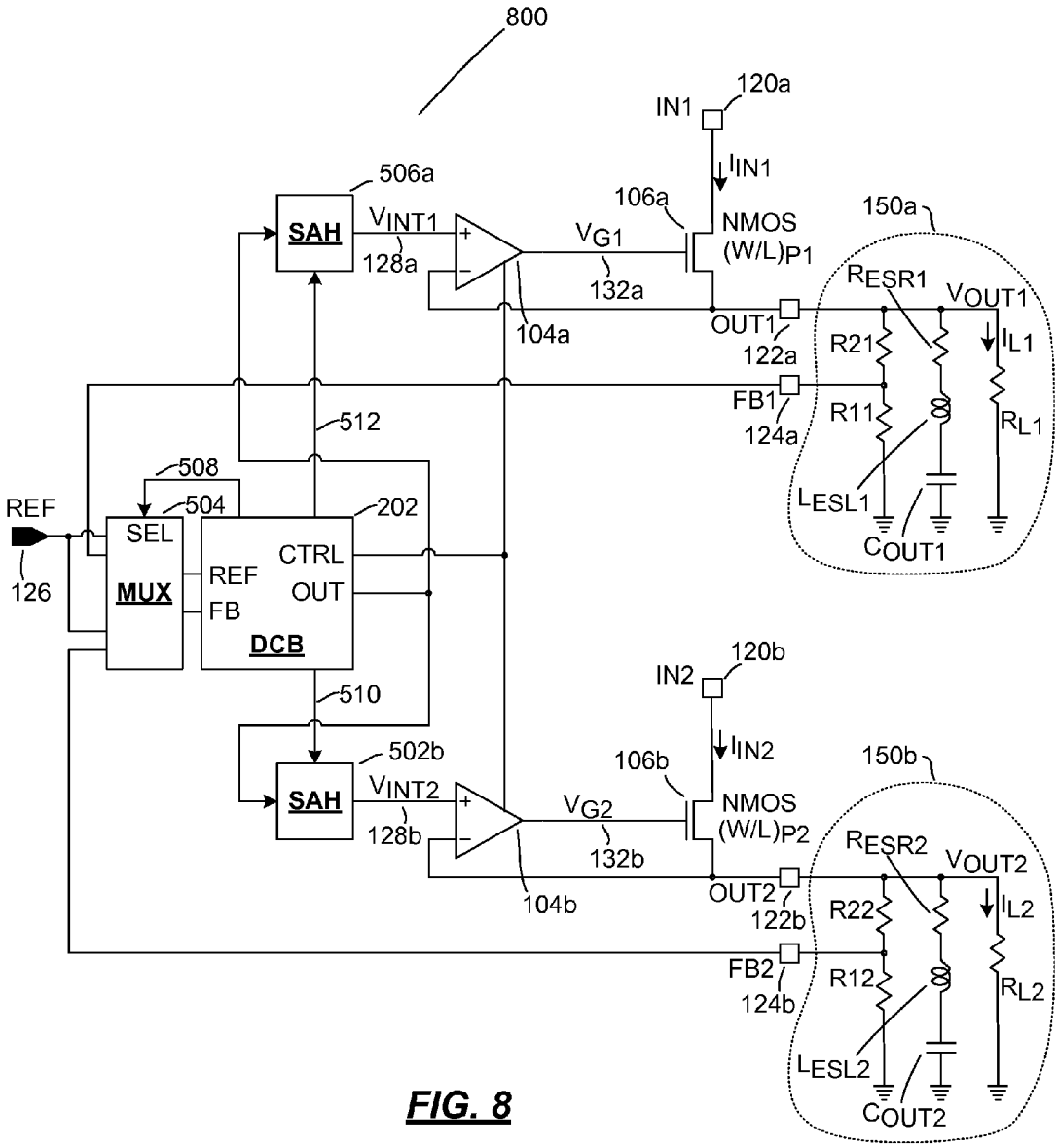
FIG. 8 is a schematic diagram of a multi-channel HLDO voltage regulator, in accordance with another embodiment of the present invention.

FIG. 8 is a schematic diagram of an HLDO 800, in accordance with another embodiment of the present invention. As shown in FIG. 8, in HLDO 800, DCB 202 controls two output voltages $V_{OUT1}$ and $V_{OUT2}$, respectively at output terminals OUT1 and OUT2 using a time domain multiplexing scheme. The Multiplexer (MUX) 504 selects the error signal from either FB1 or FB2 and supplies the selected signal to DCB 202. DCB 202 supplies its output signal OUT to one of the sample-and-hold (SAH) blocks 506*a* and 506*b*. In other words, if signal FB1 from terminals 124*a* is selected by Mux 504, output signal OUT of DCB 202 is supplied to SAH 506*a*. If, on the other hand, mux 504 selects signal FB2 from terminals 124*b*, output signal OUT of DCB 202 is supplied to SAH 506*b*. The select signal Se1 to MUX 504 is supplied by DCB 202 via. Signal CTRL is used to bias the sample-and-hold blocks 506*a* and 506*b*.

Although not shown, the time multiplexing of the DCB may be extended to more than two voltage regulation channels. Additionally, the ADC, DAC, DCE in the DCB, can be further utilized by other purposes when they are needed to process HLDO data, such as diagnostics, supervisory functions, and communications.

As described above, the DC and transient performances of an HLDO regulator in accordance with the embodiments of the present invention are handled by two separate feedback loops, thus enabling each loop's performance to be independently optimized. This, in turn, enables the HLDO regulator to be relatively very fast and highly accurate. Furthermore, since accurate ADCs and DACs may be implemented in CMOS technologies, and a multitude of HLDO channels may be integrated on the same chip, an HLDO in accordance with any of the embodiments described above, achieves many advantages.

The above embodiments of the present invention are illustrative and not limiting. Various alternatives and equivalents are possible. The invention is not limited by the type of amplifier, current source, transistor, etc. The invention is not limited by the type of integrated circuit in which the present invention may be disposed. Nor is the invention limited to any specific type of process technology, e.g., CMOS, Bipolar, or BICMOS that may be used to manufacture the present invention. Other additions, subtractions or modifications are obvious in view of the present disclosure and are intended to fall within the scope of the appended claims.

What is claimed is:

1. A voltage regulator circuit adapted to supply N regulated output voltages, the voltage regulator circuit comprising:

a digital control block operative to receive a first reference voltage and selectively receive one of N feedback voltages; and N voltage regulation channels each associated with one of the N feedback voltages, each voltage regulation channel comprising:

a sample-and-hold block responsive to an output of said digital control block;

an amplifier responsive to an output of an associated sample-and-hold block; and a transistor having a first terminal responsive to an output of an associated amplifier, a second terminal receiving one of N input voltages to be regulated, and a third terminal supplying one of N regulated output voltages, wherein the output voltage of the digital control block causes a difference between the associated received feedback voltage and the first reference voltage to be less than a predefined value, wherein said regulated output voltages are responsive to the reference voltage.

2. A voltage regulator circuit adapted to supply N regulated output voltages, the voltage regulator circuit comprising:

a digital control block operative to receive a first reference voltage and selectively receive one of N feedback voltages; and N voltage regulation channels each associated with one of the N feedback voltages, each voltage regulation channel comprising:

a sample-and-hold block responsive to an output of said digital control block;

an amplifier responsive to an output of an associated sample-and-hold block; and a transistor having a first terminal responsive to an output of an associated amplifier, a second terminal receiving an input voltage to be regulated, and a third terminal supplying one of N regulated output voltages, wherein the output voltage of the digital control block causes a difference between the associated received feedback voltage and the first reference voltage to be less than a predefined value, wherein said regulated output voltages are responsive to the reference voltage, wherein N is equal to or greater than one.

* * * * *